US008805253B2

(12) United States Patent
Nomura et al.

(10) Patent No.: US 8,805,253 B2
(45) Date of Patent: Aug. 12, 2014

(54) IMAGE FORMING APPARATUS HAVING CURVED CONTACT SURFACE

(75) Inventors: Takashi Nomura, Numazu (JP); Akimichi Suzuki, Yokohama (JP); Hisayuki Tomura, Izunokuni (JP)

(73) Assignee: Canon Kabushiki Kaisha, Tokyo (JP)

( * ) Notice: Subject to any disclaimer, the term of this patent is extended or adjusted under 35 U.S.C. 154(b) by 477 days.

(21) Appl. No.: 13/022,121

(22) Filed: Feb. 7, 2011

(65) Prior Publication Data

US 2011/0194879 A1 Aug. 11, 2011

(30) Foreign Application Priority Data

Feb. 9, 2010 (JP) ..... 2010-026531

(51) Int. Cl.
*G03G 15/20* (2006.01)

(52) U.S. Cl.
USPC ..... 399/310; 399/313; 399/314; 399/318

(58) Field of Classification Search
USPC ..... 399/310, 314
See application file for complete search history.

(56) References Cited

U.S. PATENT DOCUMENTS 5,697,030 A * 12/1997 Hayashi et al. ..... 399/299
5,697,033 A * 12/1997 Ichikawa et al. ..... 399/310
5,893,665 A * 4/1999 Ichikawa et al. ..... 399/314
5,918,096 A 6/1999 Sano et al.
6,529,701 B2 * 3/2003 Baba et al. ..... 399/307
7,835,678 B2 11/2010 Yasumaru et al.
2002/0006295 A1 * 1/2002 Kitahara ..... 399/310
2003/0143002 A1 * 7/2003 Eun et al. ..... 399/310
2009/0196663 A1 8/2009 Yasumaru et al.
2013/0136509 A1 * 5/2013 Suzuki et al. ..... 399/302
2013/0322935 A1 * 12/2013 Ichihashi et al. ..... 399/314
2014/0050510 A1 * 2/2014 Yasumaru et al. ..... 399/313

FOREIGN PATENT DOCUMENTS

JP 9-230709 A 9/1997

* cited by examiner

*Primary Examiner* — David Gray
*Assistant Examiner* — Geoffrey Evans
(74) *Attorney, Agent, or Firm* — Fitzpatrick, Cella, Harper & Scinto

(57) ABSTRACT

An image forming apparatus includes an image bearing member for bearing a toner image, a movable endless transfer belt for transferring the toner image from the image bearing member onto a transfer material, and a transfer device for transferring the toner image from the image bearing member toward the transfer belt. The transfer device includes a transfer member for sliding on an inner surface of the transfer belt in contact with the inner surface, a supporting member for supporting the transfer member, and an urging member for urging the supporting member toward the transfer belt, wherein the transfer member contacts the inner surface of the transfer belt at a contact surface thereof without rotation relative to the supporting member during movement of the transfer belt. The supporting member is rotatable about a center axis during movement of the transfer belt, and the contact surface is convex with predetermined curvature toward the transfer belt.

20 Claims, 9 Drawing Sheets

| | m | n | θ max | x1'(θ max)/x1 | x2'(θ max)/x2 | LN/R | LN'(θ max)/LN |
|---|---|---|---|---|---|---|---|
| EXP. 1 | 0.90 | 1.20 | 10 | 1.09 | 0.94 | 0.96 | 1.01 |
| EXP. 2 | 0.85 | 1.50 | 5 | 1.07 | 0.94 | 1.31 | 1.01 |
| EXP. 3 | 0.90 | 1.00 | 15 | 1.00 | 1.00 | 0.87 | 1.00 |
| COMP. 1 | 0.90 | NO CUR-VATURE | 10 | 0.65 | 1.38 | 0.87 | 1.02 |
| COMP. 2 | 0.90 | 2.00 | 10 | 1.35 | 0.79 | 1.25 | 1.07 |

(a)

(b)

(c)

| | SCATTERING | IMAGE DENSITY |
|---|---|---|
| EXP. 1 | ○ | ○ |
| EXP. 2 | ○ | ○ |
| EXP. 3 | ○ | ○ |
| COMP. 1 | ○ | × |
| COMP. 2 | × | ○ |

IMAGE FORMING APPARATUS HAVING CURVED CONTACT SURFACE

FIELD OF THE INVENTION AND RELATED ART

The present invention relates to an image forming apparatus for transferring a toner image carried on an image bearing member onto an intermediary transfer belt or a recording material carried on a recording material carrying belt.

The image forming apparatus, including a photosensitive drum and a transfer roller, for transferring the toner image on the surface of the photosensitive drum onto the intermediary transfer belt or the recording material carried on the recording material carrying belt, to be nipped between the photosensitive drum and the transfer roller has been conventionally known.

Here, e.g., in order to efficiently transfer the toner image from the photosensitive drum onto the intermediary transfer belt, there is a need to ensure a predetermined contact width with respect to a belt conveyance direction at a contact portion between the transfer roller and the recording material carried on the recording material carrying belt. However, in order to provide the contact width which is larger than a predetermined value, an outer diameter of the transfer roller is required to be set at a larger value. Thus, there arises a problem such that it is difficult to realize downsizing of the image forming apparatus. In order to solve the problem, an image forming apparatus is disclosed in Japanese Laid-Open Patent Application (JP-A) Hei 09-230709.

The image forming apparatus disclosed in JP-A Hei 09-230709 includes, in place of the transfer roller, a slidable transfer member to be slidable on the photosensitive drum or a conveyed recording material. According to the image forming apparatus described in JP-A Hei 09-230709, the slidable transfer member as a transfer member is, compared with the transfer roller as the transfer member, capable of suppressing a dimension thereof, so that the downsizing of the image forming apparatus can be realized.

Next, e.g., when the image forming apparatus is used for a long term, there arises a problem such that a frictional force is increased with time by sliding of the slidable transfer member on the intermediary transfer belt thereby to increase a torque necessary to drive the intermediary transfer belt. Or, e.g., when the image forming apparatus is used for a long term, there arises a problem such that a frictional force is increased with time by sliding of the slidable transfer member on the recording material carried on the recording material carrying member thereby to increase a torque necessary to drive the recording material carried on the recording material carrying member. In these cases, due to the increase in frictional force, a contact secondary transfer is formed intermittently at a contact portion between the slidable transfer member and the intermediary transfer belt or a contact portion between the slidable transfer member and the recording material carried on the recording material carrying belt, so that a transfer electric field is less liable to be stabilized. In some cases, there is a possibility of breakage of the slidable transfer member itself.

However, in the image forming apparatus described in JP-A Hei 09-230709, the slidable transfer member is of a stationary type and therefore in the case where the frictional force at the contact portion between the slidable transfer member and the photosensitive drum is increased, a pressing force of the slidable transfer member against the photosensitive drum is not reduced.

SUMMARY OF THE INVENTION

A principal object of the present invention is to provide an image forming apparatus capable of suppressing a fluctuation in transfer efficiency of a toner image and scattering of toner while realizing a reduction of a torque necessary to convey a belt and improvement in contact stability between the belt and a swinging transfer member.

According to an aspect of the present invention, there is provided an image forming apparatus comprising:

an image bearing member for bearing a toner image;

a movable endless transfer belt for transferring the toner image from the image bearing member onto a transfer material; and a transfer device for transferring the toner image from the image bearing member toward the transfer belt, wherein the transfer device includes a transfer member for sliding on an inner surface of the transfer belt in contact with the inner surface, a supporting member for supporting the transfer member and an urging member for urging the supporting member toward the transfer belt, wherein the transfer member is contacted to the inner surface of the transfer belt at a contact surface thereof without rotation relative to the supporting member during movement of the transfer belt, wherein the supporting member is rotatable about a center axis thereof so as to be moved in a direction perpendicular to a movement direction of the transfer belt, and wherein the contact surface is convex with predetermined curvature toward the transfer belt.

These and other objects, features and advantages of the present invention will become more apparent upon a consideration of the following description of the preferred embodiments of the present invention taken in conjunction with the accompanying drawings.

Figure 2:
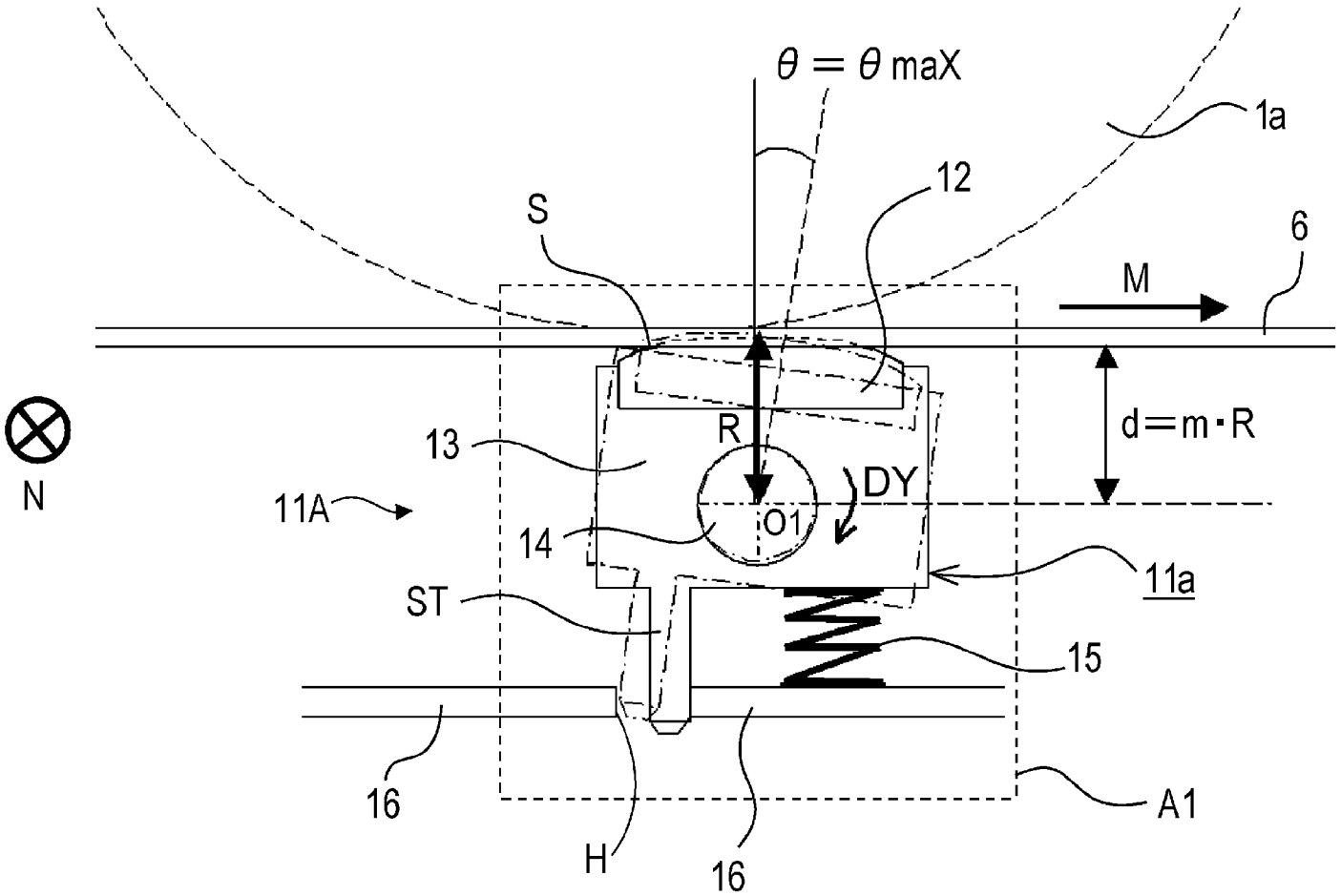
FIG. 2 is a cross-sectional view showing a structure of a primary transfer device.
Figure 3:
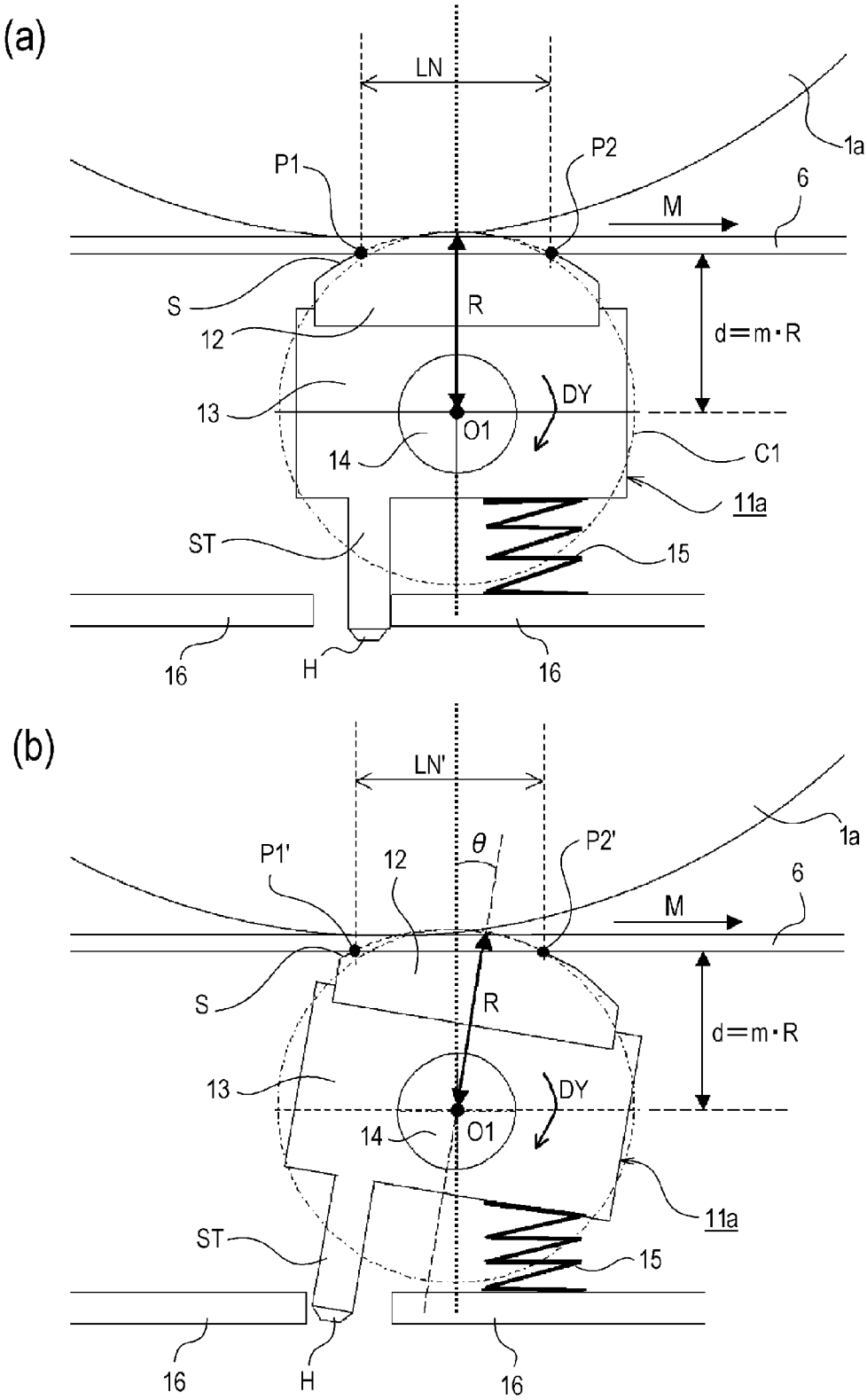

Parts (a) and (b) of FIG. 3 are enlarged views of an area A1, showing an initial state, indicated by a broken line in FIG. 2.

Figure 4:
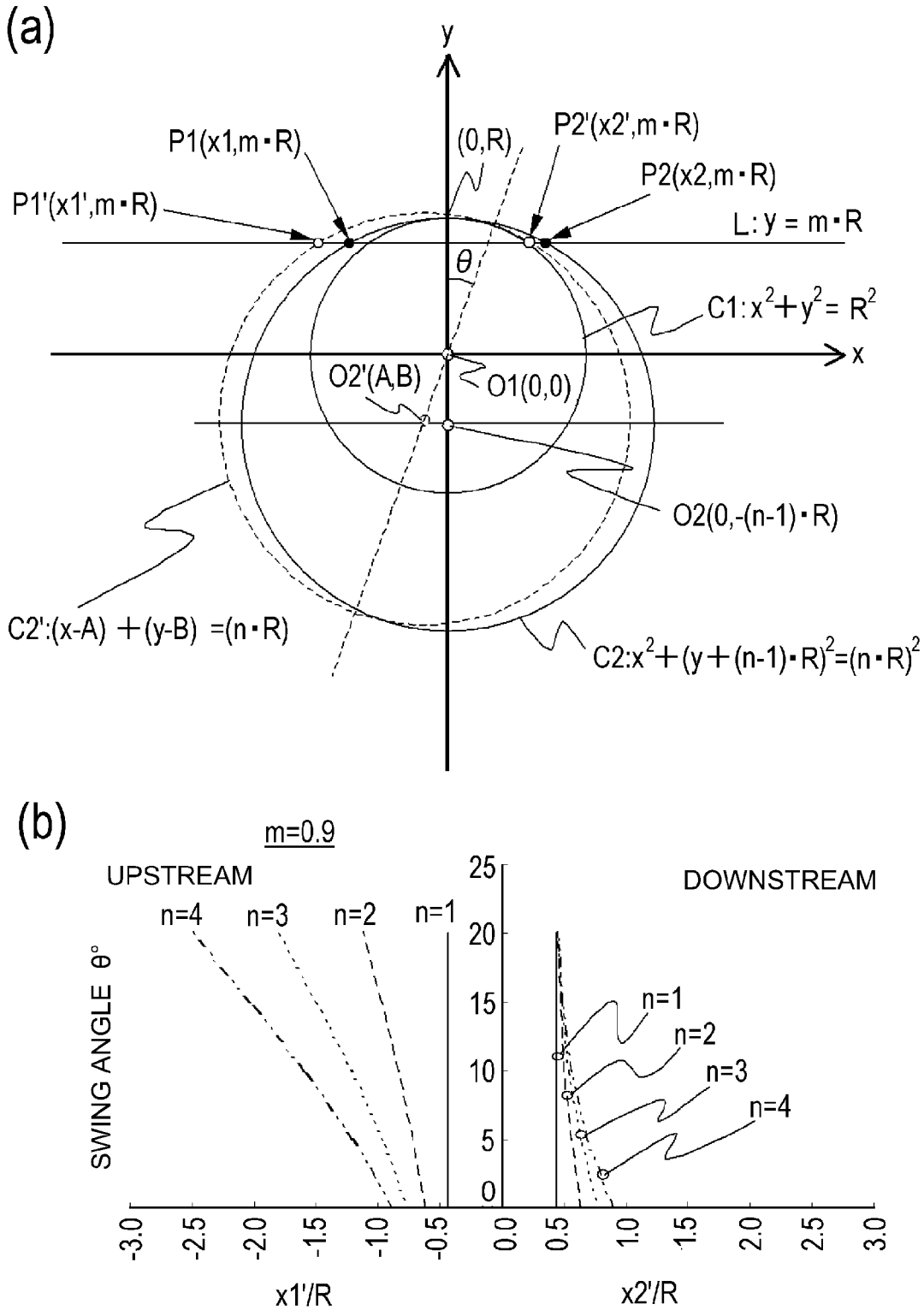

Part (a) of FIG. 4 is a schematic diagram showing a positional relationship among a sliding member, a supporting member and an intermediary transfer belt represented by a two-dimensional coordinate with a center O1 of a swinging center axis as an origin, and (b) is a graph showing a change in contact position with respect to a swinging angle.

Figure 5A:
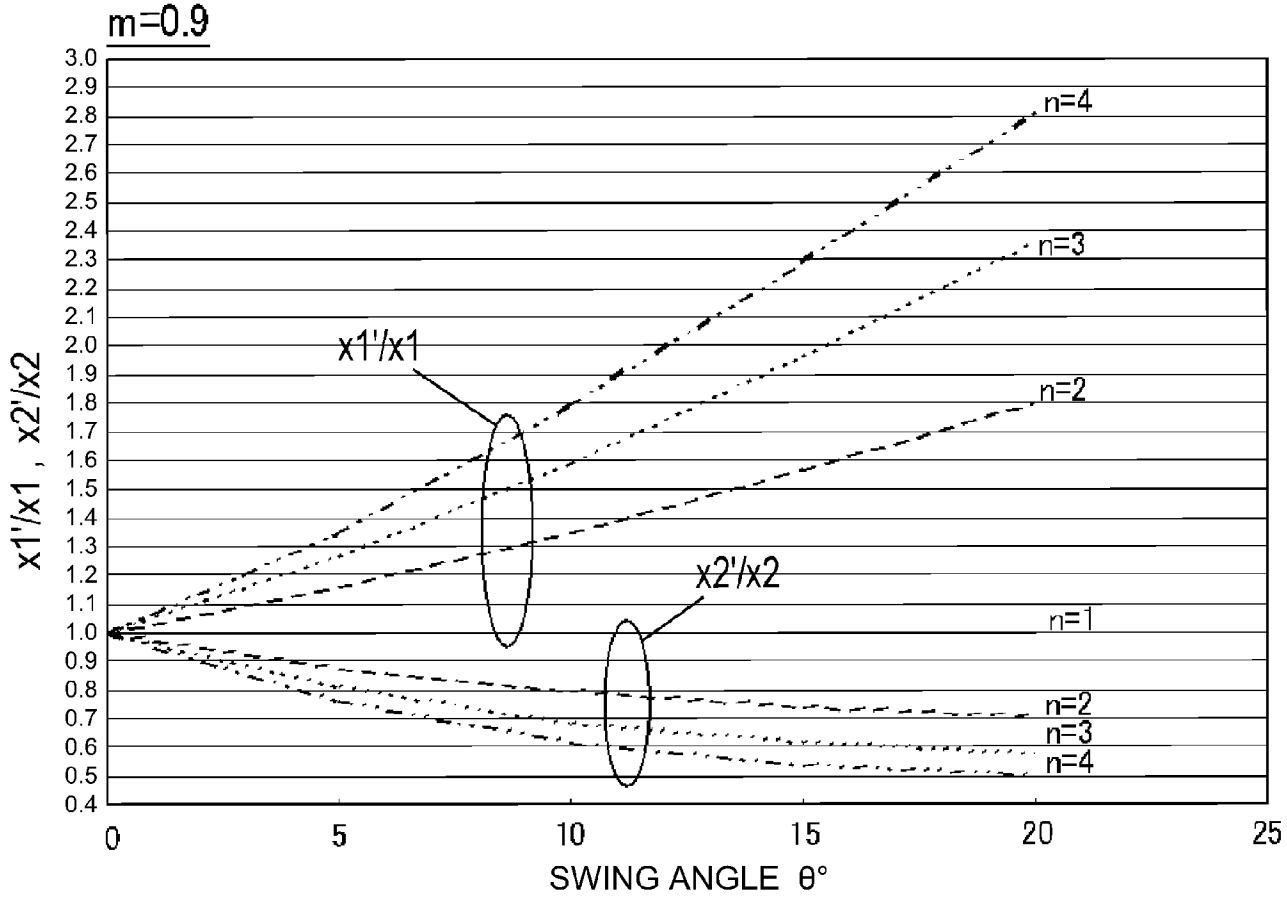
Figures 5B, 5C:
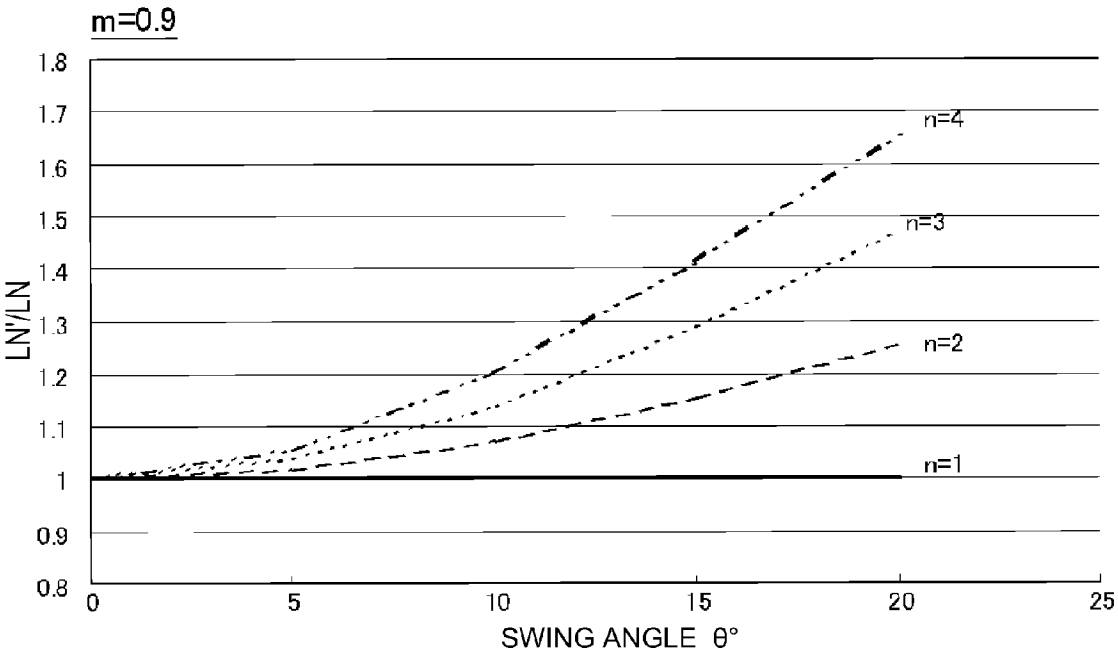

FIG. 5A is a graph showing a relationship between the swinging angle and a contact position change rate, FIG. 5B is a graph showing a relationship between the swinging angle and a contact width change rate, and FIG. 5C is a table showing various parameters with respect to the intermediary transfer belt and the sliding member.

Figure 6:
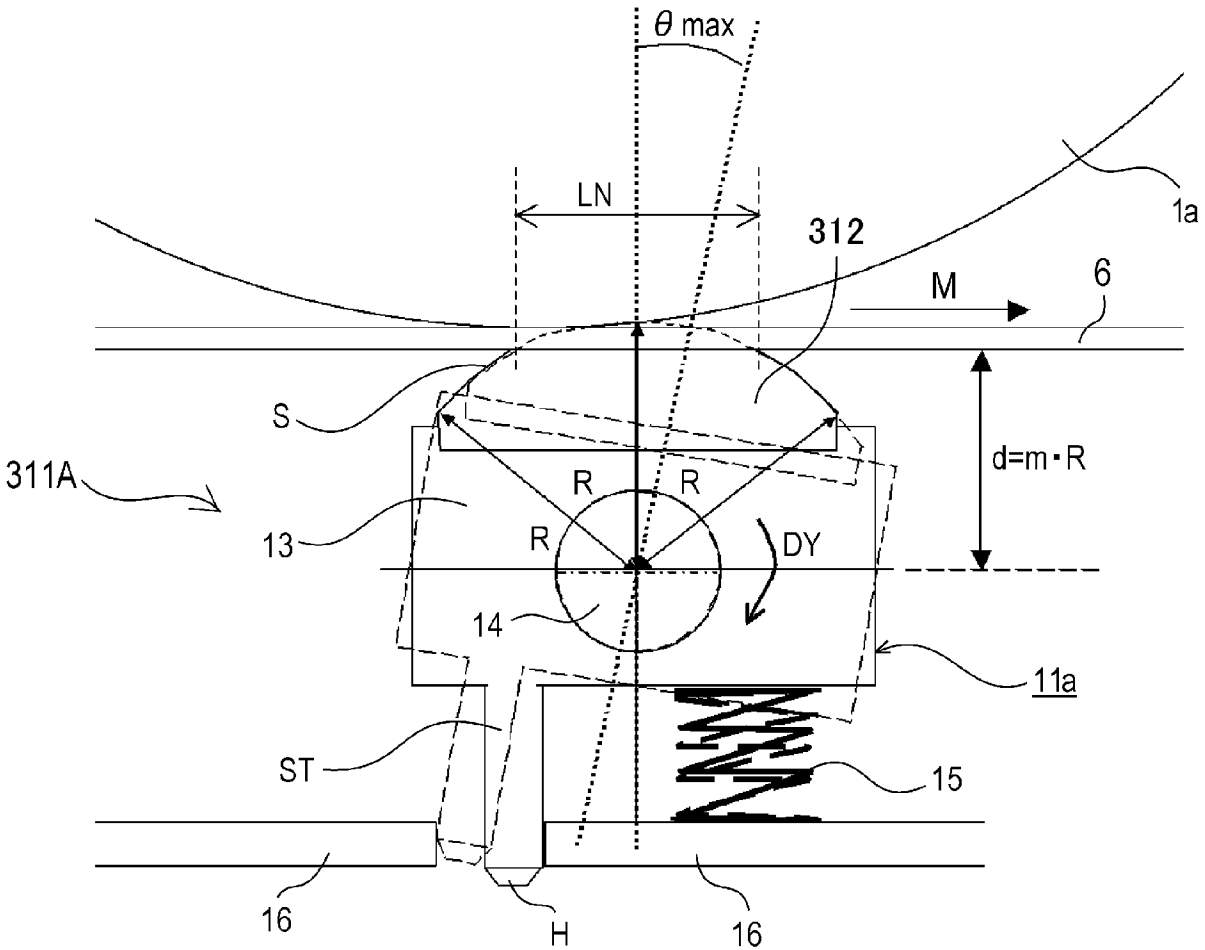

FIG. 6 is a sectional view showing a positional relationship among the sliding member, the supporting member and the intermediary transfer belt in Experimental embodiment 3 when a radius of curvature of the sliding member and a swing radius are equal to each other.

Figure 7:
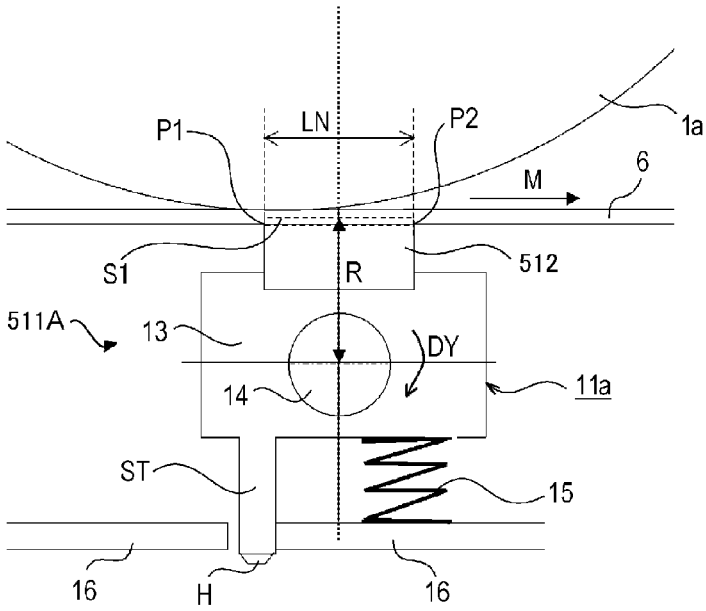
Figure 7:
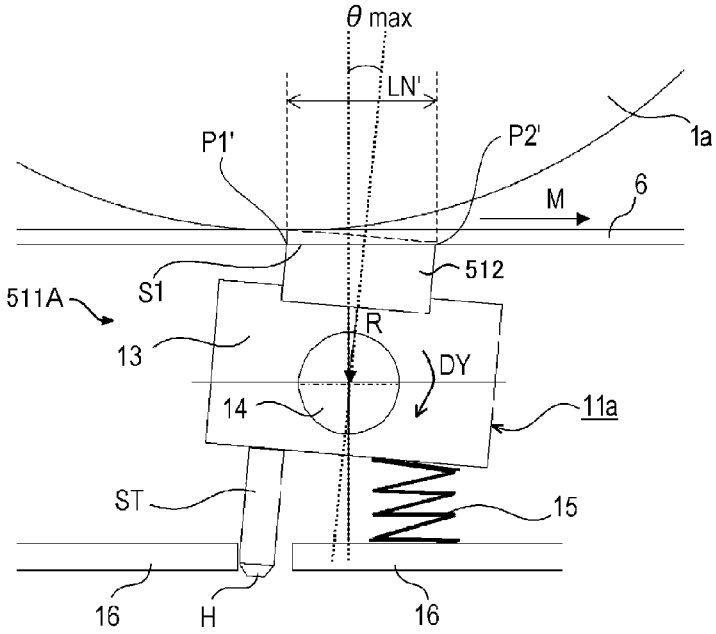

Parts (a) and (b) of FIG. 7 are sectional views showing a structure of a primary transfer device in an initial state in Comparative Embodiment 1, and (c) is a table showing evaluation results of Experimental embodiments 1 to 3 and Comparative embodiments 1 to 3 and Comparative embodiments 1 and 2.

Figure 8:
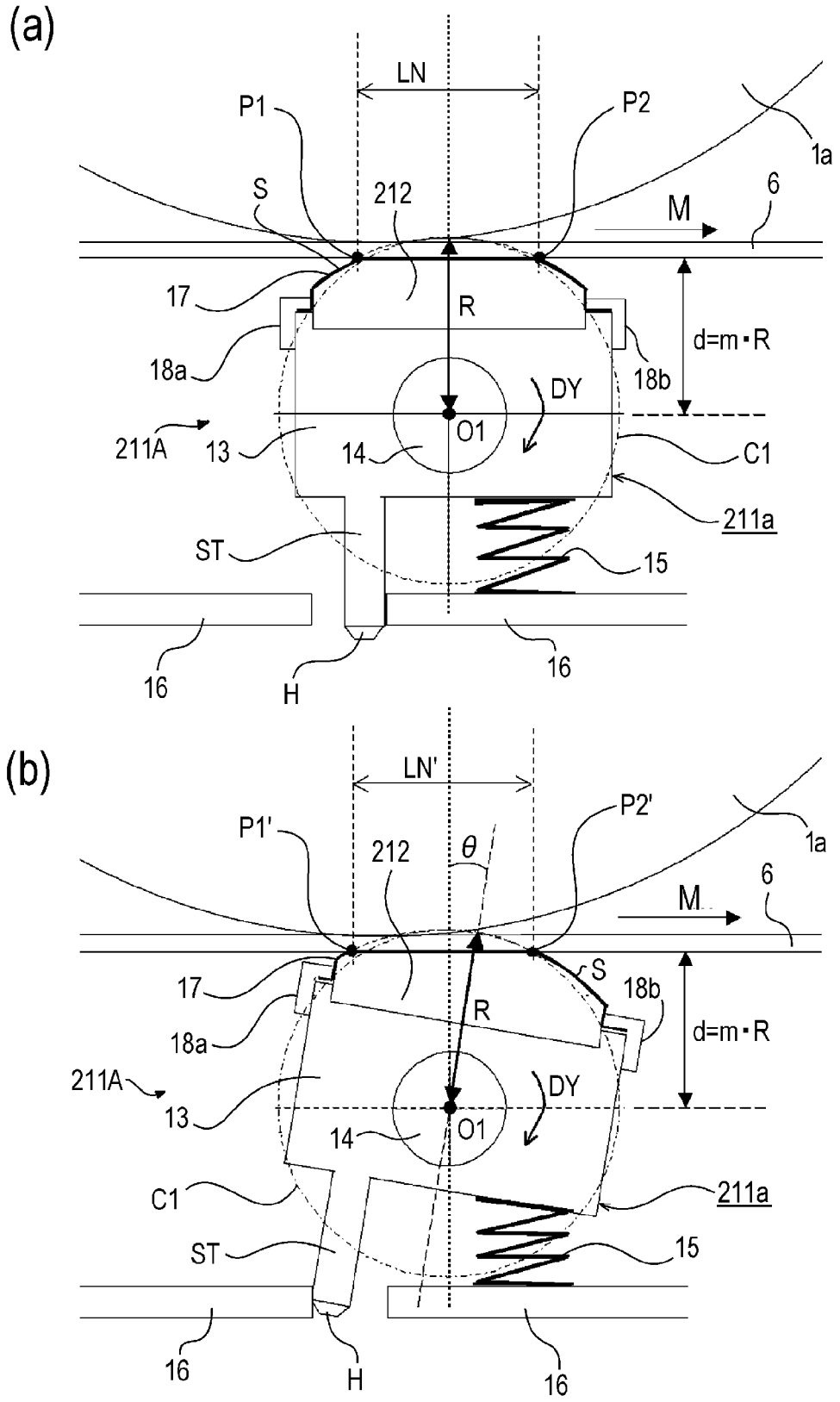

Parts (a) and (b) of FIG. 8 are sectional views showing a structure of a primary transfer device, in an initial state, provided in an image forming apparatus in a Second Embodiment.

DESCRIPTION OF THE PREFERRED EMBODIMENTS

Embodiments of the present invention will be described more specifically with reference to the drawings. Dimensions, materials, configurations, relative positions, and so on of constituent parts which will be described hereinafter may be appropriately changed depending on the structures and various conditions of an image forming apparatus to which the present invention is applied, and the present invention is not limited thereto unless otherwise specified particularly.

First Embodiment

Figure 1:
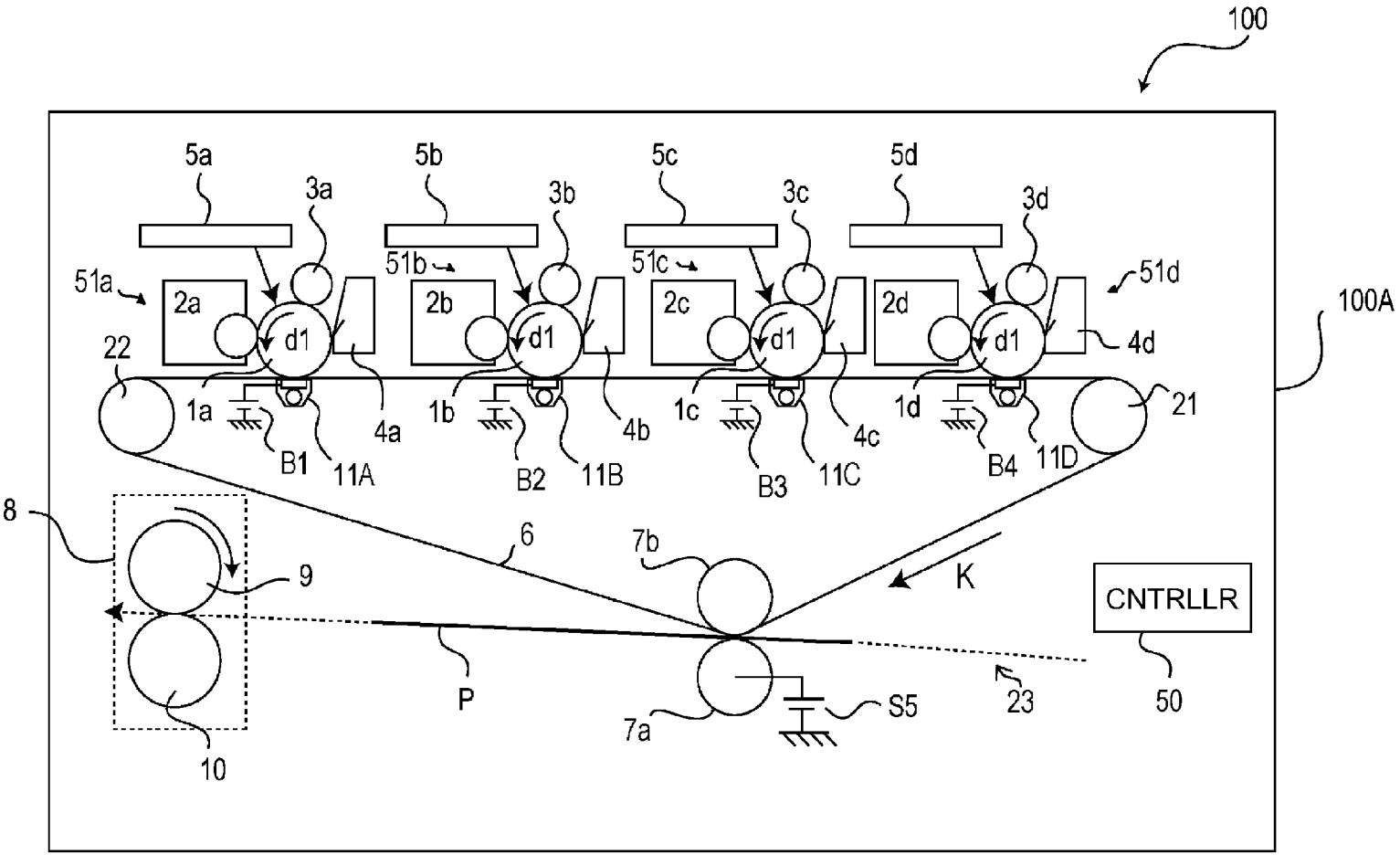
FIG. 1 is a sectional view showing a structure of an image forming apparatus according to a First Embodiment of the present invention.

FIG. 1 is a sectional view showing a structure of an image forming apparatus 100 according to First Embodiment of the present invention. The image forming apparatus 100 is a color laser printer or the like which utilizes an electrophotographic image forming process. As shown in FIG. 1, the image forming apparatus 100 includes a main assembly 100A thereof and inside the main assembly 100A, image forming portions 51 (51*a*, 51*b*, 52*c*, 51*d*) for forming images are provided. The image forming portions 51 (51*a*, 51*b*, 51*c*, 51*d*) includes photosensitive drum 1 (1*a*, 1*b*, 1*c*, 1*d*) as an image bearing member and includes primary transfer devices 11 (11A, 11B, 11C, 11D), and the like.

The image forming apparatus 100 includes an intermediary transfer belt 6 movable while being contacted to the photosensitive drum 1 (1*a*, 1*b*, 1*c*, 1*d*). Further, the image forming apparatus 100 principally includes developing devices 2 (2*a*, 2*b*, 2*c*, 2*d*) and laser scanners 5 (5*a*, 5*b*, 5*c*, 5*d*) as exposure devices, for respective colors. Further, the image forming apparatus 100 principally includes the photosensitive drums 1 (1*a*, 1*b*, 1*c*, 1*d*) as image bearing members for bearing toner images and primary charging devices 3 (3*a*, 3*b*, 3*c*, 3*d*). As the primary charging devices 3 (3*a*, 3*b*, 3*c*, 3*d*), primary charging rollers may be used. Further, the image forming apparatus 100 is an image forming apparatus of an in-line type in which cleaning devices 4 (4*a*, 4*b*, 4*c*, 4*d*) as cleaning means and primary transfer devices 11A, 11B, 11C and 11D as primary transfer means are provided. The image forming apparatus 100 includes a controller 50 as a control means, and the controller 50 is connected to a plurality of host computers through network. Print job image data sent from these host computers are receives by the controller 50. The controller 50 successively develops the image data for a plurality of print jobs into lasers lighting (turning-on) signals of the laser scanners 5*a* to 5*d* correspondingly to the respective colors.

The photosensitive drum 1*a* is uniformly charged by the primary charging device 3*a* while being rotated in a direction indicated by an arrow K at a predetermined peripheral speed. Then, the photosensitive drum 1*a* receives, via an imaging and projection optical system, a scanning laser beam which has been emitted from the laser scanner 5*a* and modulated correspondingly to a digital image signal, so that an electrostatic image for a first color component (a yellow component in this embodiment). Then, the electrostatic image is developed with a first color toner (yellow toner Y) by the developing device 2*a*, so that a visible image for the first color component is obtained. The above-described procedure is performed also with respect to a second color (magenta), a third color (cyan) and a fourth color (black).

An intermediary transfer belt 6 is rotated in a direction indicated by an arrow K at the same peripheral speed as that of the photosensitive drum 1*a*. To the primary transfer device 11A disposed oppositely to the photosensitive drum 1*a* through the intermediary transfer belt 6, a primary transfer bias supplied from a primary transfer bias voltage source B1 is applied. Thus, transfer (photosensitive drum) of the yellow visible image from the photosensitive drum 1*a* onto the intermediary transfer belt 6 is effected. Also with respect to magenta, cyan and black, associated visible images are successively superposed and primary-transferred onto the intermediary transfer belt 6 by using similar means to obtain color toner images. Incidentally, to the primary transfer devices 11B, 11C and 11D, primary transfer biases supplied from primary transfer bias voltage sources B2, B3 and B4 are applied.

The intermediary transfer belt 6 is stretched by a roller 21, a roller 22 and a secondary transfer opposite roller 7*b*, and a secondary transfer roller 7*a* is disposed at a position in which the secondary transfer roller 7*a* opposes the secondary transfer opposite roller 7*b* through the intermediary transfer belt 6 and a recording material conveying belt 23. The color toner images formed on the intermediary transfer belt 6 are collectively transferred (secondary-transferred) onto a transfer material P, which is to be conveyed, in a nip with the secondary transfer roller 7*a*. The transfer material P on which the color toner images have been secondary-transferred is conveyed to a fixing device 8, in which the color toner images are fixed by heat and pressure in a nip (fixing portion) between a heating member 9 and a pressing roller 10.

FIG. 2 is a cross-sectional view showing a structure of the primary transfer device 11A. As shown in FIG. 1, the primary transfer devices 11A, 11B, 11C and 11D have the same constitution and only the primary transfer device 11A will be described herein and the description will be used also with respect to other primary transfer devices 11B to 11D. The primary transfer device 11A includes a frame 16, a primary transfer member 11*a* and a spring 15. The primary transfer member 11*a* includes a sliding member 12 for sliding on the intermediary transfer belt 6 while contacting the intermediary transfer belt 6 and includes a supporting member 13 for supporting the sliding member 12. The sliding member 12 is mounted on the supporting member 13, and the sliding member 12 and the supporting member 13 are integrally rotatable about a center O1 of a center axis (shaft) 14. The sliding member 12 is not rotated relative to the supporting member 13. The sliding member 12 is urged against the intermediary transfer belt 6 by the spring 15. Here, the sliding member 12 may have a coating layer having a low friction coefficient in order to suppress an increase in torque due to friction with the belt at its belt contacting surface.

Further, sliding member 12 has a sliding surface S which is a contact surface on which the sliding member 12 is contacted to and slides on the intermediary transfer belt 6 while being opposed to the photosensitive drum 1*a* through the intermediary transfer belt 6. The primary transfer member 11*a* is swingable (movable) toward a downstream side with respect to a belt movement direction M in which the intermediary transfer belt 6 is to be moved. Further, the primary transfer member 11*a* is configured to transfer the toner on the surface of the photosensitive drum 1*a* onto the intermediary transfer belt 6. Further, the primary transfer member 11*a* is, as shown in a broken line area A1 indicated by a broken line, rotatable (swingable) about a swinging center axis in a direction indicated by an arrow DY. Further, the sliding surface S is formed in a convex shape toward the intermediary transfer belt 6 with predetermined curvature.

Further, the sliding member 12 is an elastic pad. The sliding surface S of the sliding member 12 is formed by a curved surface with the curvature of 1/r (radius of curvature: r). The curvature 1/r of the sliding surface S is set at a value larger than that of a flat surface. Further, the curvature 1/r of the sliding surface S is set at the value lower than that of a circle having, as a radius, a swing radius R of the primary transfer member 11*a* corresponding to a minimum distance from the center O1 of the center axis 14 to the sliding surface S in the case where the primary transfer member 11*a* and the intermediary transfer belt 6 are in a non-contact secondary transfer.

Here, a maximum angle at which the primary transfer member 11*a* is swung about the center O1 of the center axis 14 toward the downstream side with respect to the belt movement direction M is θ (=θmax). In the case where the primary transfer member 11*a* and the intermediary transfer belt 6 are in the non-contact secondary transfer, the swing radius R of the primary transfer member 11*a* corresponding to the minimum distance from the center O1 of the swinging center axis to the sliding surface S is a distance from the center of the swinging center axis 14 in a secondary transfer (indicated by a solid line) in which the primary transfer member 11*a* is not swung to an end of the sliding member 12 (in an undeformed secondary transfer) with respect to a direction perpendicular to the movement direction of the intermediary transfer belt 6. Further, in the case where the primary transfer member 11*a* and the intermediary transfer belt 6 are in a contact secondary transfer, an axis-belt distance corresponding to a minimum distance from the center O1 of the swinging center axis 14 to a back (inner) surface of the intermediary transfer belt 6 is d. Further, a proportion of the axis-belt distance d to the swing radius R is m (0<m≤1). In this case, a relationship between the axis belt distance d and the swing radius R is represented by d=m×R (0<m≤1).

A proportion of the radius of curvature r of the sliding surface S to the swing radius R is n (1≤n). In this case, a relationship between the radius of curvature r of the sliding surface S and the swing radius R is represented by r=n×R. Accordingly, the radius of curvature of the sliding surface S of the primary transfer member 11*a* is represented by 1/r=1/(n×R)(1≤n). During an image forming operation, the sliding member 12 is configured to be contacted to and slide on the intermediary transfer belt 6 at a part of the sliding surface S.

During the image formation, the intermediary transfer belt 6 is moved in the movement direction M and at the same time the primary transfer member 11*a* is swung in a direction indicated by an arrow DY depending on a frictional force between the intermediary transfer belt 6 and the sliding surface S. As a result, similarly as in a conventional device of a swinging transfer type, a swinging frictional force exerted between the intermediary transfer belt 6 and the sliding surface S is reduced.

The supporting member 13 includes a projected plate-like rotation prevention portion ST extended in a belt width direction N (perpendicular to the drawing sheet (plane) of FIG. 2). This rotation prevention portion ST is inserted in a rotation preventing (regulating) hole H formed in the frame 16 by being extended in the belt width direction N. When the primary transfer member 11*a* is in a secondary transfer in which the primary transfer member 11*a* is tilted by the angle θ=θmax as shown in FIG. 2 by a chain line, the rotation prevention portion ST is contacted to an edge portion of the frame 16 with respect to the rotation preventing hole H, thus being prevented from being further rotated.

Incidentally, in the following description, the secondary transfer of the primary transfer member 11*a* indicated by the solid line in FIG. 2 is referred to as an initial state, and the secondary transfer of the primary transfer member 11*a* indicated by the chain line in FIG. 2 is referred to as a maximum swinging secondary transfer.

Part (a) of FIG. 3 is an enlarged view of the broken line area A1 of FIG. 2 in which the initial state is shown, and (b) of FIG. 3 is an enlarged view of the broken line area A1 of FIG. 2 in which a swinging secondary transfer (0<θ≤θmax). The axis-belt distance d between the intermediary transfer belt 6 and the swinging center axis 14 is represented by d=m×R (where 0<m≤1). Further, the curvature 1/r of the sliding surface S of the sliding member 12 is represented by 1/r=1/(n×R) (where n≥1), and the radius of curvature r is represented by r=n×R (where n≥1).

In the initial state, a point at which the intermediary transfer belt 6 and the sliding surface S of the sliding member 12 start contact therebetween is a contact start point P1. In the initial state, a point at which the intermediary transfer belt 6 and the sliding surface S of the sliding member 12 complete their contact is contact end point P2. Further, a distance from the contact start point P1 to the contact end point P2 is a contact width LN between the intermediary transfer belt 6 and the sliding member 12.

In the secondary transfer in which the intermediary transfer member 11*a* is swung by the angle θ, a point at which the intermediary transfer belt 6 and the sliding surface S of the sliding member 12 start contact therebetween is a contact start point P1'. In the secondary transfer in which the intermediary transfer member 11*a* is swung by the angle θ, a point at which the intermediary transfer belt 6 and the sliding surface S of the sliding member 12 complete their contact is contact end point P2'. Further, a distance from the contact start point P1' to the contact end point P2' is a contact width LN' between the intermediary transfer belt 6 and the sliding member 12.

Part (a) of FIG. 4 is a schematic diagram showing relations of constitutions and operations of the sliding member 12, the supporting member 13 and the intermediary transfer belt 6 by a two-dimensional coordinate with the center O1 of the center axis 14 as an origin. As shown in (b) of FIG. 4, in this two-dimensional coordinate, three circles C1, C2 and C2' and one rectilinear line L are shown.

The circle C1 has the center O1 (0, 0) of the center axis 14 as the center and has the swing radius R as the radius, and is represented by the following formula (1).

$$C1: x^2+y^2=R^2 \tag{1}$$

The circle C2 has a point O2 (0, (1−n)×R) as the center and has the radius of curvature r=n×R. The sliding surface S of the sliding member 12 has the curvature 1/r=1/(n×R). At the contact start point P1 (x1, m×R) and the contact end point P2 (x2, m×R), the circle C2 intersects the rectilinear line L (y=m×R) representing the intermediary transfer member 6. The circle C2 is represented by the following formula (2).

$$C2: x^2+(y+(n-1)\times R)^2=(n\times R)^2 \tag{2}$$

The circle c2' is obtained by rotating the circle C2 about the center O1 of the center axis 14 by θ (clockwise direction) and has a point O2' (A, B) as the center. At the contact start point P1' (x1', m×R) and the contact end point P2' (x2', m×R), the circle C2' intersects the rectilinear line L representing the intermediary transfer member 6. The circle C2' is represented by the following formula (3).

$$C2':(x-A)^2+(y-B)^2=(n\times R)^2 \quad (3)$$

A=(1−n)×sin θ×R

B=(1−n)×cos θ×R

The circle C2 and C2' represent the sliding surfaces S of the sliding member 12 in the initial state and the swinging secondary transfer with the angle θ (0<θ≤θmax), respectively. Further, the contact width between the intermediary transfer belt 6 and the sliding member 12 is represented by LN=x2−x1 and LN'=x2'−x1'.

Part (b) of FIG. 4 is a graph showing a change of x1' which is x-coordinate of the contact start point P1' and a change of x2' which is x-coordinate of the contact end point P2', with respect to the swinging angle θ. In (b) of FIG. 4, in the case where m is fixed at 0.9, positional relations of x1'/R and x2'/R with respect to the swinging angle θ are shown (n=1, 2, 3, 4).

In the case where n=1, i.e., the radius of curvature r of the sliding member and the swing radius R are equal to each other, even when the swinging angle θ is changed, values of x1'/R and x2'/R are not changed. The positions of x1' which is the x-coordinate of the contact start point and x2' which is the x-coordinate of the contact end point are not changed.

In the case where the radius of curvature r of the sliding member 12 is larger than the swing radius R, x1'/R is shifted toward the upstream side with respect to the belt movement direction M, and x2'/R is shifted toward the upstream side with respect to the belt movement direction M. That is, the position of x1' which is the x-coordinate of the contact start point P1' is shifted toward the upstream side, and the position of x2' which is the x-coordinate of the contact end point P2' is shifted toward the upstream side.

When x1' which is the x-coordinate of the contact start point P1' is shifted toward the upstream side, an amount of the toner transferred from the photosensitive drum 1 onto the intermediary transfer belt 6 is increased before the photosensitive drum 1 and the intermediary transfer belt 6 are contacted to each other. For this reason, a degree of scattering of the toner image becomes worse.

Further, when x2' which is the x-coordinate of the contact end point P2' is shifted toward the upstream side, abnormal electric discharge at a separation portion between the photosensitive drum 1 and the intermediary transfer belt 6 is liable to occur, so that an intermittent pattern due to the electric discharge appears on an image (hereinafter, referred to as an abnormal electric discharge image).

Here, an image formed by the image forming apparatus in which the swing radius R was 10 mm, the radius of curvature r of the sliding surface S of the sliding member 12 was 20 mm, an amount of deformation of the sliding member 12 at the contact portion between the sliding member 12 and the intermediary transfer belt 6 was 1.5 mm was checked. As a result, the scattering of the toner and the abnormal electric discharge image did not occur when the swinging angle θ was in a range of 0 to 5 degrees, so that the image was good. However, it was found that degrees of the toner scattering and the abnormal electric discharge image were worsened with an increasing swinging angle θ when the swinging angle θ exceeded 5 degrees.

The position of x1', which is the x-coordinate of the contact start point P1', at the swinging angle θ of 5 degrees was shifted toward the upstream side of the intermediary transfer belt 6 with respect to the belt movement direction M by 0.96 mm at the swinging angle θ of 0 degrees. This corresponds to about 12% of a deviation (shift) amount compared with the case of the swinging angle θ of degrees.

On the other hand, the position of x2', which is the x-coordinate of the contact end point P2', at the swinging angle θ of 5 degrees was shifted toward the upstream side of the intermediary transfer belt 6 with respect to the belt movement direction M by 0.78 mm at the swinging angle θ of 0 degrees. This corresponds to about 11% of a deviation (shift) amount compared with the case of the swinging angle θ of degrees. As a result, it was found that it is desirable that positional changes, during the swinging, of x1' which is the x-coordinate of the contact start point P1' and x2' which is the x-coordinate of the contact end point P2' are suppressed to levels of the deviation within 10% on the basis of the initial state.

FIG. 5A is a graph showing a relationship between the swinging angle θ, and a contact start point change rate x1'/x1 and a contact end point change rate x2'/x2 in the case of m=0.9 and n=3 and 4. As shown in FIG. 5A, in the case of n>1, it is understood that x1'/x1 is increased but x2'/x2 is decreased with an increasing swinging angle θ. The change rate x1'/x1 is larger than the change rate x2'/x2. With the increasing swinging angle θ, the amount of deviation of the x-coordinate x1 of the contact start point P1 between the intermediary transfer belt 6 and the sliding member 12 is larger than that of the x-coordinate x2 of the contact end point P2.

FIG. 5B is a graph showing a relationship between the swinging angle θ and a contact width change rate LN'/LN in the case of m=0.9 and n=1, 2, 3 and 4. As shown in FIG. 5B, it can be understand that the change rate x1'/x1 is larger than the contact width change rate LN'/LN between the intermediary transfer belt 6 and the sliding member 12. As a result, when a change rate Δx1(θ) of the x-coordinate x1 of the contact start point P1 is x1'(θ)/x1, by satisfying Δx1(θ)≤1.1, the change of they-coordinate x2 of the contact end point P2 on the basis of the initial state and the change of the contact width LN on the basis of the initial state can also be made within 10%.

Here, referring again to (b) of FIG. 4, x1' which is the x-coordinate of the contact start point P1' (x1', m×R) at which the rectilinear line L (y=m×R) and the circle C2' on the two-dimensional coordinate intersect each other is represented by the following formula (4).

$$x1'(\theta)=-\{\sqrt{n^2-(m-b)^2}-a\}\times R \quad (4)$$

a=(1−n)×sin θ b=(1−n)×cos θ

From the formula (4), the above-described change rate Δx1(θ)=x1'(θ)/x1 (=x1'θ/x1' (θ=0) is obtained and then when the relationship of Δx1≤1.1 is applied, the following formula (5) (relational expression 1) is obtained.

$$\Delta x1(\theta)=x1'(\theta)/x1=\frac{\sqrt{n^2-(m-b)^2}+a}{\sqrt{n^2-(m+n-1)^2}}\leq 1.1 \quad (5)$$

$$a=(1-n)\times\sin\theta$$

$$b=(1-n)\times\cos\theta$$

Accordingly, the image forming apparatus 100 of the sliding and swinging transfer type according to the present invention is configured to always satisfy the formula (5).

FIG. 5C is a table showing change rates in the maximum swinging secondary transfer to the initial state with respect to the x-coordinate x1 of the contact start point P1, the x-coordinate x2 of the contact end point P2 and the contact width LN between the intermediary transfer belt 6 and the sliding member 12 when m, n and θmax are changed in Experimental embodiments 1 to 3 and Comparative embodiments 1 and 2.

In FIG. 5C, values of x1'(θmax)/x1, x2'(θmax)/x2, and LN/R (in initial state), LN'(θmax)/LN are shown. Incidentally, Experimental embodiments 1 to 3 are constitutional embodiments of First Embodiment but Comparative embodiments 1 and 2 do not correspond to the constitutional embodiments of First Embodiment.

Hereinbelow, the respective embodiments will be described. Constitutions of Experimental embodiments 1 to 3 satisfy the above-described formula (5) (relational expression 1), and the three change rates are in a range of 0.90-1.10. On the other hand, constitutions of Comparative embodiments 1 and 2 do not satisfy the formula (5), and the three change rates are out of the range of 0.90-1.10. Incidentally, although described later, as shown in (a) and (b) of FIG. 7, in Comparative embodiment 1, a sliding member 512 does not have the curvature and thus the sliding surface with respect to the intermediary transfer belt 6 is a flat surface. The constitutions and effects of Experimental embodiments 1 to 3 and Comparative embodiments 1 and 2 will be described below.

Experimental embodiment 1 has the constitution in which the radius of curvature r of the sliding member 12 is 1.2 times the swing radius R, thus decreasing the curvature. Experimental embodiment 1 is, compared with Experimental embodiment 3, advantageous in terms of downsizing of the device since the swing radius R can be made smaller when the same contact width between the intermediary transfer belt 6 and the sliding member 12 is set.

Experimental embodiment 2 has the constitution in which the radius of curvature r of the sliding member 12 is further increased (i.e., the curvature 1/r is further decreased) so as to be 1.5 times the swing radius R< so that the swing radius R can be further decreased compared with Experimental embodiment 1. However, the changes of the contact start point P1', the contact end point P2' and the contact width LN' during the swinging become large and therefore the amounts of the changes are suppressed to 10% or less by setting the maximum swinging angle θmax at 5 degrees which is ½ of that in Experimental embodiment 1 and by setting the amount of deformation of the sliding member 12 at 0.15 (=1−m). In Experimental embodiment 2, in accordance with the formula (5), the maximum swinging angle θmax is decreased and the amount of deformation is increased. As a result, it is possible to set the curvature 1/r of the sliding member 12 at a very small value while suppressing the changes of the contact start point P1', the contact end point P2' and the contact width LN'.

FIG. 6 shows a primary transfer device 311A of the image forming apparatus in Experimental embodiment 3 and is a sectional view showing positional relationship among a sliding member 312, the supporting member 13 and the intermediary transfer belt 6 when the radius of curvature r of the sliding member 312 and the swing radius R are equal to each other. As shown in FIG. 6, even when the swinging angle θ and the amount of deformation of the sliding member 312 are any values, the x-coordinate x1 of the contact start point P1, the x-coordinate x2 of the contact end point P2 and the contact width LN are not changed from those in the initial state. For this reason, by increasing the swinging angle θ, the frictional force with the intermediary transfer belt 6 can be reduced considerably. For that reason, the primary transfer device 311A is suitable for a high-speed image forming apparatus in which the frictional force in the initial state is large.

As in Experimental embodiments 1 to 3, when the formula (5) is satisfied, m, n and θmax can be freely selected and therefore it is possible to obtain a device constitution which meets the purpose of the device while suppressing the changes of the x-coordinate x1 of the contact start point P1, the x-coordinate x2 of the contact end point P2 and the contact width LN during the swinging.

Part (a) of FIG. 7 is a sectional view showing a structure of the primary transfer device 511A in the initial state in Comparative embodiment 1, and (b) of FIG. 7 is a sectional view showing the structure of the primary transfer device 511A in the swinging secondary transfer in Comparative embodiment 1. The primary transfer device 511A in Comparative embodiment 1 includes, as described above, the sliding member 512 having a flat sliding surface Si. The settings of m and θmax are identical to those in Experimental embodiment 1.

The maximum swinging secondary transfer in Comparative embodiment 1 shown in (b) of FIG. 7 corresponds to a secondary transfer in which the x-coordinate x1 of the contact start point P1 and the x-coordinate x2 of the contact end point P2 in the initial state shown in (a) of FIG. 7 are shifted to the downstream side (P1 to P1' and P2 to P2') with respect to the belt movement direction M of the intermediary transfer belt 6. The contact width LN' between the sliding member 512 and the intermediary transfer belt 6 in the maximum swinging secondary transfer is substantially equal to the contact width LN in the initial state.

However, the x-coordinate x1' of the contact start point P1' is largely shifted toward the downstream side by 35% and therefore the positions of the contact region between the sliding member 512 and the intermediary transfer belt 6 and the contact region between the photosensitive drum 1*a* and the intermediary transfer belt 6 are largely shifted. In such a secondary transfer, the length of the intermediary transfer belt 6 sandwiched between the photosensitive drum 1*a* and the sliding member 512 is decreased, so that a transfer efficiency when the toner image is transferred from the photosensitive drum 1*a* onto the intermediary transfer belt 6 becomes worse. As a result, the toner image density is decreased and thus the image quality is lowered.

The primary transfer device (not shown) in Comparative embodiment 2 has the constitution in which the radius of curvature r of the sliding member is 2 times the swing radius R and m and θmax are set at values equal to those in the case of the primary transfer device 511A in Comparative embodiment 1. In Comparative embodiment 2, in the case where the contact width with the intermediary transfer belt 6 is made equal to that in Experimental embodiment 1, the swing radius R can be decreased considerably. For that reason, the primary transfer device in Comparative embodiment 2 is very advantageous in terms of the downsizing thereof. However, when the primary transfer device is swung until the maximum swinging angle θmax, the x-coordinate x1' of the contact start point P1 with the intermediary transfer belt 6 is shifted from that in the initial state toward the upstream side by 35%. As a result, the toner scattering becomes worse and thus the image quality is lowered.

Part (c) of FIG. 7 is a table showing evaluation results of the toner scattering and the image density in the maximum swinging secondary transfer of the sliding members 12, 312, 512 and the like in the primary transfer devices in Experimental embodiments 1 to 3 and Comparative embodiments 1 and 2. In (c) of FIG. 7, the toner scattering is evaluated as "x" when a character outline is blurred by eye observation, and the image density is evaluated as "x" when the image density measured by a densitometer ("RD-918", mfd. by Macbeth Corp.) is less than 1.2.

As described above, in Comparative embodiment 1, the contact region between the sliding member 512 and the intermediary transfer belt 6 and the contact region between the photosensitive drum 1*a* and the intermediary transfer belt 6 are largely shifted and therefore a desired image density cannot be obtained, so that the evaluation result of the image density is "x". Further, in Comparative embodiment 2, the contact start point P1' between the sliding member 512 and the intermediary transfer belt 6 is largely shifted toward the upstream side, so that the evaluation result of the toner scattering is "x".

On the other hand, in Experimental embodiments 1 to 3, the contact start point P1', the contact end point P2' and the contact width LN' between the intermediary transfer belt 6 and the sliding member 12 are less shifted from those in the initial state and therefore good results are obtained with respect to both of the toner scattering and the image density.

Second Embodiment

Part (a) of FIG. 8 is a sectional view showing a structure of a primary transfer device 211Am in the initial state, of the image forming apparatus in Second Embodiment, and (b) of FIG. 8 is a sectional view showing the structure of the primary transfer device 211A, in the swinging secondary transfer ($0<\theta\leq\theta max$). With respect to the primary transfer device 211A, portions or members having the same constitutions and effects as those for the primary transfer device 11A in First Embodiment are represented by the same reference numerals or symbols and will be appropriately omitted from description. Also in Second Embodiment, the primary transfer device 211A is applicable to the image forming apparatus similar to that in First Embodiment, so that the description of the image forming apparatus will be omitted. The primary transfer device 211A in Second Embodiment is different from the primary transfer device 11A in First Embodiment in that the primary transfer device 211A in Second Embodiment is further provided with an electroconductive sliding sheet member 17 between the sliding member 12 and the intermediary transfer belt 6 in First Embodiment.

In Second Embodiment, the primary transfer device 211A includes the frame 16, a primary transfer member 211*a* and the spring 15. The primary transfer member 211*a* includes a pressing member 212 for pressing the sheet member and a sheet-like sliding sheet member 17. The sliding sheet member 17 is mounted on the pressing member 212 and has the sliding surface S which is opposed to the photosensitive drum la through the intermediary transfer belt 6 and is contacted to the intermediary transfer belt 6, and exhibits electroconductivity.

In the primary transfer device 211A in Second Embodiment, as the sliding sheet member 17, a 150 μm-thick sheet (film) of polyethylene (PE) in which carbon black has been added so as to exhibit electroconductivity is used.

The sliding sheet member 17 is fixed on the pressing member 212 so as to follow the curvature 1/r of the pressing member 212 by sheet fixing members 18*a* and 18*b*. As the sliding sheet member 17, by selecting the sliding sheet member which has a friction coefficient, between the sliding sheet member and the intermediary transfer belt 6, smaller than that between the sliding member 12 and the intermediary transfer belt 6 in First Embodiment, it is possible to improve the sliding property compared with that in First Embodiment. Further, by employing such a constitution that the sheet pressing member 212 is made insulative and a transfer voltage is directly supplied from the primary transfer voltage source B1 to the sliding sheet member 17, a range of choice of the material for the pressing member 212 can be enlarged and it is also possible to enhance design latitude.

As the pressing member 212, similarly as in First Embodiment, one satisfying the formula (5) is used, and the sliding sheet member 17 is provided so as to follow the curvature of the pressing member 212. Therefore, with respect to the contact start point P1', the contact end point P2' and the contact width LN' between the sliding sheet member 17 and the intermediary transfer belt 6 during the swinging, the amounts of shift from those in the initial state fall within 10% or less.

As described above, in Second Embodiment, compared with First Embodiment, the good image in the initial state can be maintained also during the swinging while improving the sliding property by decreasing the frictional force at the transfer portion.

According to the image forming apparatuses in First Embodiment and Second Embodiment described above, the primary transfer members 11*a* and 211*a* are swung with an increasing sliding frictional force between the intermediary transfer belt 6 and the primary transfer members 11*a* and 211*a*. Therefore, when compared with the constitution using the stationary slidable transfer member which is not swung, a pressing force of the primary transfer members 11*a* and 211*a* against the intermediary transfer belt 6 is reduced, so that a sliding resistance of the primary transfer members 11*a* and 211*a* on the intermediary transfer belt 6 is reduced. As a result, reduction in torque necessary to drive the intermediary transfer belt 6 is realized.

In addition, according to the image forming apparatuses in First and Second Embodiments. The sliding surfaces S of the primary transfer members 11*a* and 211*a* are formed with predetermined values of the curvature. Therefore, when compared with the constitution in which the primary transfer member is formed to have the flat surface, the changes in contact width LN and contact position between the sliding surface S and the intermediary transfer belt 6 are suppressed. As a result, contact stability of the primary transfer members 11*a* and 211*a* with the intermediary transfer belt 6 is good, so that the fluctuation in transfer efficiency of the toner image from the photosensitive drum 1*a* onto the intermediary transfer belt 6 and the image defect such as the toner scattering are suppressed.

Therefore, according to the image forming apparatuses in First and Second Embodiments, the contact stability of the primary transfer members 11*a* and 211*a* with the intermediary transfer belt 6 is good while realizing the reduction in torque necessary to drive the intermediary transfer belt 6, so that the transfer efficiency fluctuation of the toner image and the image defect such as the toner scattering are suppressed.

Further, according to the image forming apparatuses in First and Second Embodiments, the swinging ranges of the primary transfer members 11*a* and 211*a* satisfy the formula (5) described above, the toner scattering and the abnormal electric discharge image can be obviated with accuracy.

Further, according to the image forming apparatus in Second Embodiment, the transfer member is constituted by the pressing member 212 and the sliding sheet member 17. As a result, the pressing member 212 performs the function as the elastic member and the sliding sheet member 17 performs the function as the electroconductive member, thus realizing function separation. Thus, the range of choice of the materials for the supporting member 13 and the sheet pressing member 212 is enlarged and the design latitude of the device is enhanced.

Incidentally, in First and Second Embodiments, as the example, the image forming apparatus of the intermediary transfer type using the intermediary transfer belt 6 is described but the present invention is not limited only to the intermediary transfer type. For example, a similar effect can be achieved by applying the present invention to an image forming apparatus of a direct transfer type in which the transfer material is conveyed between a transfer belt and the photosensitive drum and the toner image on the photosensitive drum is directly transferred onto the transfer material.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 026531/2010 filed Feb. 9, 2010, which is hereby incorporated by reference.

What is claimed is:

1. An image forming apparatus comprising:

an image bearing member for bearing a toner image;

a movable endless transfer belt for transferring the toner image from said image bearing member onto a transfer material; and a transfer device for transferring the toner image from said image bearing member toward said transfer belt, wherein said transfer device includes a transfer member for sliding on an inner surface of said transfer belt in contact with the inner surface, a supporting member for supporting said transfer member, and an urging member for urging said supporting member toward said transfer belt, wherein said transfer member contacts the inner surface of said transfer belt at a contact surface thereof without rotation relative to said supporting member during movement of said transfer belt, wherein said supporting member is rotatable about a center axis during movement of said transfer belt, and wherein the contact surface is convex with a continuous curvature toward said transfer belt over an entire contact surface area as seen in a direction perpendicular to a movement direction of said transfer belt.

2. An apparatus according to claim 1, wherein said transfer member is a sliding member having the contact surface.

3. An apparatus according to claim 1, wherein said transfer member includes a pressing member supported by said supporting member and includes a sheet-like electroconductive member, mounted on said pressing member, having a contact surface to be contacted to said transfer belt by being pressed by said pressing member.

4. An apparatus according to claim 1, wherein said transfer belt is an intermediary transfer belt.

5. An apparatus according to claim 1, wherein said transfer belt is a recording material conveying belt.

6. An apparatus according to claim 1, wherein said transfer member is an elastic member.

7. An apparatus according to claim 1, wherein said supporting member is rotated in the same direction as a movement direction of said transfer belt by a moving force of said transfer belt to tilt said transfer member.

8. An apparatus according to claim 7, wherein said supporting member tilts said transfer member by the moving force of said transfer belt to alleviate an urging force of said urging member against said transfer member.

9. An apparatus according to claim 7, wherein said urging member is a spring.

10. An apparatus according to claim 1, wherein said transfer device includes a prevention portion for preventing rotation of said supporting member, and wherein said supporting member contacts said prevention portion to stop rotation thereof.

11. An image forming apparatus comprising:

an image bearing member for bearing a toner image;

a movable endless transfer belt for transferring the toner image from said image bearing member onto a transfer material; and a transfer device for transferring the toner image from said image bearing member toward said transfer belt, wherein said transfer device includes a transfer member for sliding on an inner surface of said transfer belt in contact with the inner surface, a supporting member for supporting said transfer member, and an urging member for urging said supporting member toward said transfer belt, wherein said transfer member contacts the inner surface of said transfer belt at a contact surface thereof without rotation relative to said supporting member during movement of said transfer belt, wherein said supporting member is rotatable about a center axis during movement of said transfer belt, and wherein when a maximum angle of rotation of said supporting member about the center axis toward a downstream side with respect to a movement direction of said transfer belt is θ, a swing radius of said supporting member corresponding to a maximum distance from a center of the center axis to the contact surface in a non-contact secondary transfer between said supporting member and said transfer belt is R, an axis-belt distance corresponding to a minimum distance from the center of the center axis to a rear surface of said transfer belt is d, a proportion of the axis-belt distance to the swing radius is m, with $0<m\leq 1$, a radius of curvature of the contact surface is r, and a proportion of the radius of curvature to the swing radius is n, with $1\leq n$, the following relationship is satisfied:

$$\frac{\sqrt{n^2-(m-b)^2}+a}{\sqrt{n^2-(m+n-1)^2}} \leq 1.1(a=(1-n)\times\sin\theta,\ b=(1-n)\times\cos\theta).$$

12. An apparatus according to claim 11, wherein said transfer member is a sliding member having the contact surface.

13. An apparatus according to claim 11, wherein said transfer member includes a pressing member supported by said supporting member and includes a sheet-like electroconductive member, mounted on said pressing member, having a contact surface to be contacted to said transfer belt by being pressed by said pressing member.

14. An apparatus according to claim 11, wherein said transfer belt is an intermediary transfer belt.

15. An apparatus according to claim 11, wherein said transfer belt is a recording material conveying belt.

16. An apparatus according to claim 11, wherein said transfer member is an elastic member.

17. An apparatus according to claim 11, wherein said supporting member is rotated in the same direction as a movement direction of said transfer belt by a moving force of said transfer belt to tilt said transfer member.

18. An apparatus according to claim 17, wherein said supporting member tilts said transfer member by the moving force of said transfer belt to alleviate an urging force of said urging member against said transfer member.

19. An apparatus according to claim 17, wherein said urging member is a spring.

20. An apparatus according to claim 11, wherein said transfer device includes a prevention portion for preventing rotation of said supporting member, and wherein said supporting member contacts said prevention portion to stop rotation thereof.

* * * * *